US005343620A

United States Patent [19]

Velluet

[11] Patent Number: 5,343,620

[45] Date of Patent: Sep. 6, 1994

[54] TUBULAR HEADER FOR A HEAT EXCHANGER AND A METHOD OF MAKING SUCH A HEAT EXCHANGER

[75] Inventor: Pascal Velluet, Cernay la Ville, France

[73] Assignee: Valeo Thermique Moteur, Le Mesnil-Saint-Denis, France

[21] Appl. No.: 46,452

[22] Filed: Apr. 13, 1993

[30] Foreign Application Priority Data

Apr. 16, 1992 [FR] France ..... 92 04708

[51] Int. Cl.[5] ..... F28F 9/02

[52] U.S. Cl. ..... 29/890.043; 29/890.052; 165/173; 165/175

[58] Field of Search ..... 165/173, 176, 175; 290/890.052, 890.043

[56] References Cited

U.S. PATENT DOCUMENTS

| | | | |
|---|---|---|---|
| 3,411,196 | 11/1968 | Zehnder | 165/175 |
| 4,825,941 | 5/1989 | Hoshino et al. | 165/110 |
| 4,971,145 | 11/1990 | Lyon | 165/173 |
| 5,009,262 | 4/1991 | Halstead et al. | 165/173 X |
| 5,048,602 | 9/1991 | Motohashi et al. | 165/173 |
| 5,062,476 | 11/1991 | Ryan et al. | 165/173 |
| 5,101,887 | 4/1992 | Kado | 165/76 |
| 5,186,244 | 2/1993 | Joshi | 165/176 X |

FOREIGN PATENT DOCUMENTS

| | | | |
|---|---|---|---|
| 0479775 | 4/1992 | European Pat. Off. | F28F 9/02 |
| 0480914 | 4/1992 | European Pat. Off. | F25B 39/04 |
| 3191 | 1/1988 | Japan | 165/176 |
| 176397 | 7/1990 | Japan | 165/173 |
| 36497 | 2/1991 | Japan | 165/173 |

*Primary Examiner*—John Rivell
*Assistant Examiner*—L. R. Leo
*Attorney, Agent, or Firm*—Morgan & Finnegan

[57] ABSTRACT

A heat exchanger, typically a condenser for a motor vehicle air conditioning system, comprises a set of tubes aligned with each other and having their ends extending through apertures into the interior of a tubular wall of a header of the heat exchanger, the tubes being secured to the header. The tubular wall is formed with at least one internal projection against which the end of each tube is abutted.

2 Claims, 1 Drawing Sheet

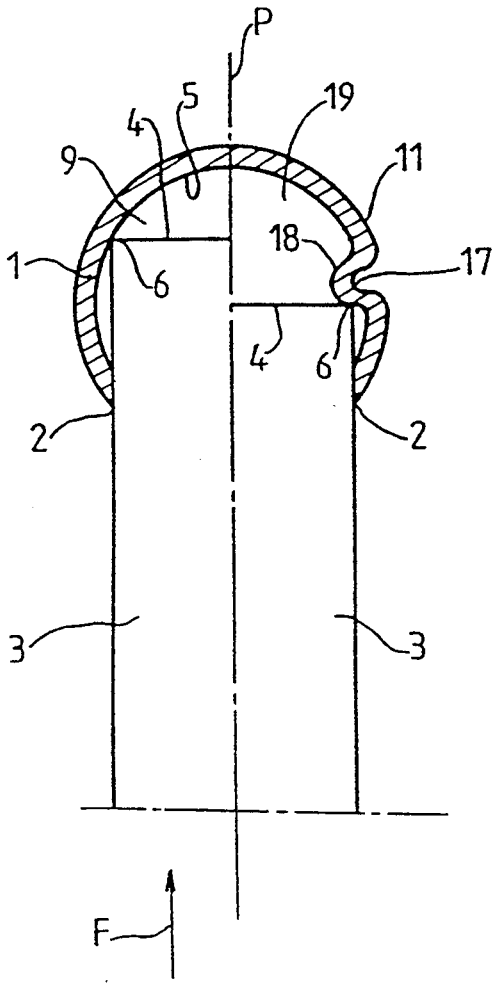
P
5
19
4
9
11
18
1
6
17
4
6
2
2
3
3
F

TUBULAR HEADER FOR A HEAT EXCHANGER AND A METHOD OF MAKING SUCH A HEAT EXCHANGER

FIELD OF THE INVENTION

The present invention relates to heat exchangers of the kind comprising a fluid header communicating with a plurality of fluid flow tubes which are parallel and aligned with each other, the fluid header comprising a tubular wall which extends in the same direction as that in which the tubes are aligned with each other, with a multiplicity of apertures being formed in the wall, and with the tubes passing through the said apertures and into the header.

BACKGROUND OF THE INVENTION

In one known method for making such a heat exchanger, especially where the latter is intended for use as a condenser in an air conditioning installation for a motor vehicle, the ends of the fluid flow tubes are introduced into respective ones of the apertures in the tubular wall of the header. The tubes are then displaced parallel to the direction of their length, until their ends come into abutment against the internal surface of the fluid header.

Since the profile of this internal surface is generally circular, the ends of the tubes make contact with the wall at the level of the centre of its circular profile if their width in the radial direction is equal to its diameter. If the width of each tube is smaller than the diameter of the internal surface of the tubular header, the ends of the tubes make contact with the latter beyond its centre; and the smaller the ratio of tube width to wall diameter, the further away is the point of contact between the end of the tube and the interior of the wall. The space which is available in the fluid header facing towards the ends of the tubes can thus become too small for satisfactory fluid flow to occur between the tubes and the header. In addition, this space may vary from one tube to another due to manufacturing tolerances.

DISCUSSION OF THE INVENTION

An object of the invention is to overcome these drawbacks.

According to the invention in a first aspect, a method of making a heat exchanger comprising a fluid header communicating with a multiplicity of parallel fluid circulating tubes which are aligned with each other, in which the fluid header comprises a tubular wall extending in the direction in which the tubes are aligned and having a multiplicity of apertures through which the tubes extend, and in which the said method includes introducing the ends of the tubes into respective ones of the said apertures in the tubular wall, and displacing the tubes parallel to their longitudinal direction, is characterised in that the end of each tube abuts against at least one internal projection of the tubular wall.

Preferably, the end of each tube makes contact with the, or at least one, said projection through at least one of its two regions furthest away from the median plane of the aligned array of tubes.

In one embodiment of the invention, the tubular wall has a multiplicity of said internal projections aligned with each other in the longitudinal direction of the wall, each projection being disposed in line with respective ones of the said tubes.

In another embodiment of the invention, the tubular wall has a said internal projection extending continuously along the wall and extending towards the set of tubes.

If desired, it can be arranged that the end of each tube makes abutting engagement on two said internal projections, which lie respectively on either side of the median plane of the set of aligned tubes.

According to the invention in a second aspect, a tubular wall constituting a fluid header for a heat exchanger, preferably made by the method according to the said first aspect of the invention, has a multiplicity of apertures aligned with each other in the longitudinal direction of the wall for insertion of tubes of the heat exchanger in the wall, together with a corresponding multiplicity of internal projections carried by the said wall, each said projection being disposed in line with the corresponding aperture in the longitudinal direction of the tubular wall and being offset with respect to the latter in its circumferential direction, the projections being aligned with each other in the longitudinal direction.

In a modification, the tubular wall has a internal projection carried by the wall and extending continuously along the tubular wall, this projection being offset from the apertures in the circumferential direction.

The internal projection (or each such projection) may be formed by recessing the wall from outside.

Further features and advantages of the invention will appear more clearly from the detailed description for a preferred embodiment of the invention which follows, and which is given by way of example only and with reference to the accompanying drawing.

BRIEF DESCRIPTION OF THE DRAWING

The single FIGURE of the drawing is a view of a heat exchanger in cross section, showing part of the heat exchanger only; in the left hand half of the drawing it is shown when made by a known method, while the right hand half of the drawing shows the heat exchanger when made by the method in accordance with the present invention.

DESCRIPTION OF A PREFERRED EMBODIMENT OF THE INVENTION

The left hand half of the drawing shows in transverse cross section a tubular wall 1 having a circular profile, being the wall of a header of a condenser for an air conditioning system in a motor vehicle. The wall 1 has an aperture 2, together with further apertures which are aligned with the latter in the longitudinal direction of the wall 1. A fluid circulation tube 3, extending in a longitudinal direction which is at right angles to that of the wall 1, and which has a transverse cross section which is elongated transversely to this latter direction, extends through the aperture 2. Other similar tubes, aligned with the tube 3, extend through the other apertures in the wall 1. The end 4 of the tube 3 has been pushed into the header through the aperture 2 in accordance with the arrow F, parallel to the longitudinal direction of the tube. It is pushed in until it comes into abutment, against the cylindrical internal surface 5, of the tubular wall, through its two marginal regions 6 which lie furthest away from the median plane P of the array of tubes. These two regions 6 are symmetrical with each other about the plane P. The latter contains the longitudinal axis of the wall 1 and the tube 3.

The right hand half of the drawing shows a tubular wall 11 having the same basically circular profile as the wall 1, but being modified locally by a recess which defines an inward projection 18 of the tubular wall. The projection 18 is offset in the circumferential direction from the apertures 2, the latter being identical with those in the wall 1. The projection 18 is continuous along the tubular wall, and projects generally towards the apertures in the latter. A fluid circulating tube 3 can also be seen in the drawing, this being identical to the tube shown on the left hand side, but with its penetration within the tubular wall 1 being limited by abutting contact of the marginal region 6 of its end 4 against the projection 18. The free space 19 which subsists within the fluid header at the end 4 of the tube 3 is larger than the corresponding space 9 in the known type of heat exchanger. In addition, this space is not affected by dimensional variations the width of the tube 3, so long as the projection 18 extends sufficiently far towards the plane P to be always in contact with the end of the tube.

The continuous recess 17 may be replaced by a multiplicity of recesses which are aligned with each other in the longitudinal direction of the tubular wall, with each of the corresponding inward projections making contact with the end of a respective one of the tubes 3. If desired, two projections, or two series of projections, may be provided on either side of the plane P, for example symmetrically about the latter, so as to come into contact with the two marginal regions 6, respectively, of the ends of the tubes.

The projection 18 (or each projection) may of course, be made by any other means than recessing; in particular, if the header is extruded, this projection may be formed during the operation of extruding the header.

The tubular wall 11 may consist of a single sheet metal component, for example a substantially rectangular sheet, rolled and brazed edge to edge. It can also comprise two components sealingly assembled together, with each component extending over part of the circumference and with the projection or projections 18 being formed on at least one of these two components.

I claim:

1. A method of making a heat exchanger having a fluid header and a multiplicity of fluid flow tubes disposed parallel with each other and aligned with each other to define a median plane of alignment of the tubes, the fluid header having a continuous tubular wall extending along the plane and defining a plurality of apertures, with the tubes extending through the apertures, the wall being formed with at least one internal projection, wherein the method comprises the steps of forming the at least one internal projection from the outside of the continuous tubular wall, introducing end portions of the respective tubes into the apertures in the continuous tubular wall, and displacing the tubes parallel to their length until the free end of each tube comes into abutment with the at least one internal projection of the continuous tubular wall, the end of each tube contacting the at least one internal projection through at least one of its two regions lying furthest away from the median plane, the tubular wall has at least one internal projection extending continuously along the wall and facing towards the set of tubes, and forming a recess on the outside of the continuous tubular wall to form a corresponding internal projection.

2. A method according to claim 1, in which the tubular wall has at least one internal projection, arranged on either side of the median plane, and wherein the end of each tube is displaced until it abuts the corresponding at least one internal projection disposed in line with that tube.

* * * * *